US009802222B2

(12) United States Patent
Oldorff

(10) Patent No.: US 9,802,222 B2
(45) Date of Patent: Oct. 31, 2017

(54) METHOD FOR TREATING A PANEL OF WOOD-BASED MATERIAL AND BUILDING PANEL WITH A CORE OF WOOD-BASED MATERIAL

(71) Applicant: FLOORING TECHNOLOGIES LTD., Pieta (MT)

(72) Inventor: Frank Oldorff, Schwerin (DE)

(73) Assignee: FLOORING TECHNOLOGIES LTD, Kalkara (MT)

( * ) Notice: Subject to any disclaimer, the term of this patent is extended or adjusted under 35 U.S.C. 154(b) by 0 days.

(21) Appl. No.: 14/441,602

(22) PCT Filed: Nov. 7, 2013

(86) PCT No.: PCT/EP2013/003341
§ 371 (c)(1),
(2) Date: May 8, 2015

(87) PCT Pub. No.: WO2014/072051
PCT Pub. Date: May 15, 2014

(65) Prior Publication Data

US 2015/0283849 A1 Oct. 8, 2015

(30) Foreign Application Priority Data

Nov. 12, 2012 (EP) ..... 12007667

(51) Int. Cl.

| | |
|---|---|
| ***B44C 5/00*** | (2006.01) |
| ***B05D 1/38*** | (2006.01) |
| ***B05D 7/08*** | (2006.01) |
| ***B05D 7/00*** | (2006.01) |
| ***B05D 5/00*** | (2006.01) |
| ***B05D 3/02*** | (2006.01) |
| ***B44C 5/04*** | (2006.01) |
| ***B05D 7/06*** | (2006.01) |

(52) U.S. Cl.
CPC ..... *B05D 7/52* (2013.01); *B05D 1/38* (2013.01); *B05D 3/0254* (2013.01); *B05D 5/00* (2013.01); *B05D 7/06* (2013.01); *B05D 7/08* (2013.01); *B05D 7/544* (2013.01); *B05D 7/546* (2013.01); *B44C 5/043* (2013.01); *B44C 5/0476* (2013.01); *B05D 2203/20* (2013.01); *B05D 2505/00* (2013.01); *Y10T 428/24868* (2015.01)

(58) Field of Classification Search
CPC ..... B05D 1/38; B05D 3/0254; B05D 5/00; B05D 7/08; B05D 7/52; B05D 7/544; B05D 7/546; B05D 2203/20; B05D 2505/00
USPC ..... 427/393, 397, 408
See application file for complete search history.

(56) References Cited

U.S. PATENT DOCUMENTS

| | | | | |
|---|---|---|---|---|
| 4,450,194 | A * | 5/1984 | Kauffman | B32B 5/24 428/172 |
| 5,266,384 | A | 11/1993 | O'Dell et al. | |
| 5,928,778 | A * | 7/1999 | Takahashi | B44C 5/04 428/323 |
| 6,040,044 | A * | 3/2000 | Takahashi | B44C 5/04 428/323 |
| 7,527,856 | B2 * | 5/2009 | Thiers | B32B 27/18 427/212 |
| 2002/0081353 | A1 * | 6/2002 | Kurzinger | A23K 50/80 426/2 |
| 2007/0113970 | A1 * | 5/2007 | Hansson | B32B 27/42 156/277 |
| 2009/0087643 | A1 | 4/2009 | Gottzmann et al. | |
| 2009/0208710 | A1 | 8/2009 | Pershing et al. | |

FOREIGN PATENT DOCUMENTS

| | | |
|---|---|---|
| EP | 1339545 B1 | 9/2003 |
| EP | 1512468 B1 | 3/2005 |
| EP | 2098304 A2 | 9/2009 |
| EP | 2338693 B1 | 6/2011 |
| WO | WO-9301935 | 2/1993 |
| WO | WO-2007079547 | 7/2007 |
| WO | WO-2008005228 | 1/2008 |

OTHER PUBLICATIONS

"Glass" from Wikipedia, https://en.wikipedia.org/wiki/glass, retrieved on Apr. 13, 2017, 21 pages.*

* cited by examiner

*Primary Examiner* — William Phillip Fletcher, III
(74) *Attorney, Agent, or Firm* — Andrew M. Calderon; Roberts Mlotkowski Safran Cole & Calderon, P.C.

(57) ABSTRACT

A method for treating a panel of wood-based material to achieve an adhesive-free surface after a decoration (2) has been printed onto at least an upper side of the panel of wood-based material, is distinguished by the fact that a cellulose-free top layer (3) of melamine resin with mixed-in glass beads (5) is applied to the decoration (2), and this top layer (8) is dried before a wear-resistant layer (6) is applied to the top layer (8).

21 Claims, 1 Drawing Sheet

METHOD FOR TREATING A PANEL OF WOOD-BASED MATERIAL AND BUILDING PANEL WITH A CORE OF WOOD-BASED MATERIAL

FIELD OF THE INVENTION

The invention relates to a method for treating a woodbase material board for the purpose of achieving a tack-free surface following the application of a decoration to at least one top face of the woodbase material board, and to a construction board having a core of woodbase material (woodbase material board), the surface thereof having been treated by the method.

DISCUSSION OF BACKGROUND INFORMATION

Woodbase material boards of this kind are widespread and are used in many different fields. One particularly large field of use is their application as flooring panels. In the context of this use in particular, the woodbase material boards provided with the decoration are subject to high loading. In order that they withstand these loadings, the decorative layer must be covered with a protective layer. The latter consists generally of a synthetic resin, such as melamine resin, to which various adjuvants have been admixed. As a result of the different layers applied to the woodbase material board, there are tensile stresses, which can lead to dishing of the woodbase material board. For this reason it is necessary for both the top and bottom faces of the woodbase material board to be coated, in order to allow these forces to occur evenly on both sides and thus to prevent dishing.

EP 2 338 693 B1 discloses the application, to the top face and/or bottom face of the woodbase material board bearing the decoration, of a first upper resin layer which comprises corundum particles, the drying of this upper resin layer, and then the application of a second resin layer which comprises cellulose. The second resin layer is then dried, and atop this second resin layer a third resin layer is applied, which comprises glass particles and is dried.

EP 1 339 545 B1 discloses an antiwear layer based on synthetic resin that can be used to protect from wear the surfaces of furniture or of floors, consisting of a decorative paper and optionally further papers lying above the decorative paper. This antiwear layer comprises resin material particles having a Mohs hardness of at least 6, and further compact, round particulate solids substantially free from cut edges, these particulate solids being in the form of beads having a Mohs hardness of at least 5. The latter beads may be glass beads.

EP 1 512 468 B1 describes a method for sealing a construction board made from wood or from a woodbase material. There, first of all, liquid resin is applied to the top face and is then dried. The construction board is then compressed under the effect of temperature, with the resin undergoing at least partial melting. Additionally, according to EP 2 098 304 A2, a relief may also be embossed into the melting resin, corresponding to the decoration on the top face of the woodbase material board.

In all of the known methods, a foamed layer of melamine resin and cellulose fibers is applied to the large-format woodbase material board, coated directly with a decoration, and following application this foamed layer is actively dried in order to protect the decoration and so to allow the board to be stacked and stored. A board coated directly with a decoration means a board whose top face is imprinted with a decoration in one or more plies; in other words, no decorative paper is used. The decoration may be printed directly onto the top face of the woodbase material board, or a priming coat may be provided between the top face and the decorative layer.

A customary layer system on the top face of a woodbase material board consists of 15 to 40 g/m$^2$ of primer, which consists of an aqueous melamine resin. Applied atop this primer layer, as a white base, is an aqueous white paint in an amount of 20 to 30 g/m$^2$. The decoration consists customarily of two, three, or four decorative prints applied to the white base. This decoration is then covered with a covering varnish which consists of an aqueous melamine resin/cellulose fiber mixture, which is foamed immediately prior to application. The covering varnish is applied in an amount of 10 to 15 g/m$^2$.

The covering varnish is necessary in order to protect the decoration in subsequent operations and coating of the woodbase material board in the downstream manufacturing operation. The boards are not necessarily processed to completion in a continuous procedure, but instead are entirely likely to be put in interim storage, and stacked with one another for that purpose. The covering varnish is necessary, consequently, but is particularly critical in its application, having consequences, in particular, in downstream operations, resulting in product-critical error patterns through to rejection. The range here lies between a melamine resin/cellulose fiber mixture with too little foaming, which can lead to instances of sticking between decorated woodbase material boards within a stack, and an excessively foamed melamine resin/cellulose fiber mixture, which can lead to the graying of the decoration, something which does not become apparent, however, until after lamination in a short-cycle press.

Various attempts to adjust the foaming and to keep it constant have failed, since the processing operation divides up in terms of time and physical location, thereby making a regulatory intervention impossible or possible only at unacceptably high levels of cost and inconvenience.

SUMMARY OF THE INVENTION

Since there is of course great interest in a secure operation for the production of laminates, the problem addressed by the invention is that of improving the method described at the outset such that on the one hand a tack-free surface of the woodbase material board is achieved, in order to allow the intermediate to be stacked in a further processing operation, while on the other hand obtaining a surface which can be further-processed reliably and without color deviation.

This problem is solved by the application to the decoration of a cellulose-free outer layer of melamine resin, into which glass beads have been mixed, and by the drying of this outer layer before an antiwear layer is applied to it.

The use of glass beads in place of cellulose in the melamine resin is accompanied by significant advantages in terms of processing quality and technological values of the product. The melamine resin is preferably a melamine/formaldehyde resin (M/F resin) in which the cellulose fibers admixed in a manner known from the prior art are split into shorter fiber chains, in other words undergoing swelling. As a result of the swelling of the cellulose fibers, the viscosity of the melamine resin is massively increased, making it problematic to use over the long term. In the case of the glass beads, especially when they are used, preferably, in silanized form, there are no disruptive secondary reactions observed that adversely influence the flow properties of the melamine resin. While almost all of the cellulose is bound physically into the melamine/formaldehyde resin network, the silane groups of the glass beads enter into a strong covalent bond with the hydroxyl groups of the resin. In this way the glass is tied chemically into the three-dimensional polymer network and hence more strongly, leading to better abrasion resistance and scratch resistance by comparison with cellulose fibers. Furthermore, the glass itself has a greater hardness than cellulose fibers. The glass beads mixed into the melamine resin produce a uniform, rough surface, which is very important for further processing, but does not stick.

In principle it is possible with cellulose too to generate a rough surface, but the woodbase material boards coated accordingly tend to stick together within a stack on storage and are therefore no longer suitable for further processing. The sticking of the woodbase material boards comes about through a thermal-catalytic condensation between the cellulose fibers in the resin and the wood fibers of the upper board. When silanized glass beads are used, there can be no sticking. Moreover, the glass beads are substantially more temperature-stable, and so in the further laminating procedure, when the woodbase material board is pressed, the outer layer does not become cloudy.

The outer layer is preferably dried actively, in order to shorten the production time.

The melamine resin/glass bead mixture is applied preferably in an amount of 10 to 30 g/m$^2$, preferably 12 to 20 g/m$^2$. The fraction of glass beads in the mixture is 12 to 16 wt %.

The diameter of the glass beads mixed in is in the range from 60 to 110 μm, especially preferably in the range from 60 to 90 μm or from 70 to 110 μm.

A construction board, more particularly a flooring panel, which has been coated from a woodbase material board produced according to the method described, is notable for having a core of woodbase material, a decoration printed at least onto one top face of the core, and an outer layer which covers the decoration and which consists on the basis of melamine resin, and also an antiwear layer which is applied to the outer layer and which has abrasive particles, wherein the outer layer is cellulose-free and comprises glass beads.

The abrasive particles in the antiwear layer are preferably corundum. It is, though, also possible to use glass beads, as already known in principle from the prior art described above.

BRIEF DESCRIPTION OF THE DRAWINGS

A drawing is used to describe in more detail one exemplary embodiment of the invention hereinbelow.

In the drawing

DETAILED DESCRIPTION OF THE PRESENT INVENTION

Figure 2:
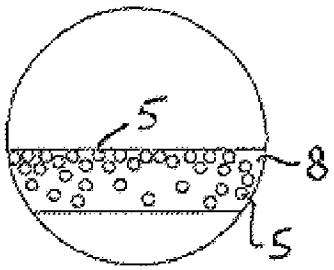
FIG. 2 shows the detail II of FIG. 1.
Figure 1:
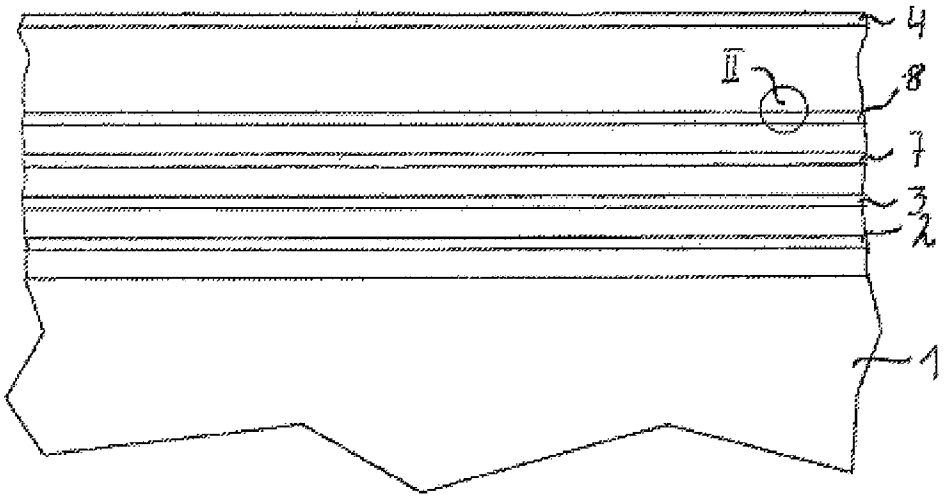
FIG. 1 shows a diagrammatic cross section through a woodbase material board.

The coating of the woodbase material board is to be described hereinbelow with reference to FIG. 1.

A primer layer 2 composed of 15 to 40 g/m$^2$ of an aqueous melamine resin is applied first of all to the top face of the core 1, which consists of wood fibers, of woodchips, or of a woodbase material/plastic mixture. Applied atop this primer layer 2 then, as a further print base layer, is a white base 3, by application of 20 to 30 g/m$^2$ of an aqueous white paint. The decoration 7 consists of a plurality of—preferably two, three, or four—successively applied decorative prints, which are applied, for example, by offset printing or by means of a digital printer (inkjet printer). The outer layer 8 consists of an aqueous melamine resin/glass bead mixture, with an application quantity of 10 to 30 g/m$^2$. The melamine resin is preferably a melamine/formaldehyde resin, and the glass beads 5 which are mixed into the resin have a diameter of 60 to 90 μm or of 70 to 110 μm. The diameter range may of course also be from 60 to 110 μm. After the outer layer 8 has been actively dried, in a subsequent coating step an antiwear layer 4 composed of a melamine resin/corundum/cellulose fiber mixture is applied in an amount of 30 to 50 g/m$^2$. After the drying of this final coating, the woodbase material board is pressed in a short-cycle press with exposure to a high pressure and a high temperature. This woodbase material board can then be divided up, in further processing steps, into panels, and a tongue/groove profiling can then be machined into the side edges of these panels. Tongue and groove can be provided with integrated locking means and latching means, in order to allow the panels to be laid subsequently without glue.

In experiments it has been found that with a melamine resin/glass bead mixture, a substantially greater amount, namely 10 to 30 g/m$^2$, preferably 12 to 20 g/m$^2$, can be applied than using a conventional melamine resin/cellulose mixture. Different abrasion classes AC are distinguished according to DIN EN 13329. AC3 requires at least 2000 revolutions, and AC4 at least 4000 revolutions. The experimental procedures below gave the following results:

Experimental Procedure 1 "AC3"

- Resin mixture application of 12 g/m$^2$ containing 12 wt % of glass with specification of 60 to 90 μm, resulting in abrasion of 2400 revolutions
- Resin mixture application of 16 g/m$^2$ containing 12 wt % of glass with specification of 60 to 90 μm, resulting in abrasion of 2600 revolutions
- Resin mixture application of 20 g/m$^2$ containing 12 wt % of glass with specification of 60 to 90 μm, resulting in abrasion of 2800 revolutions Experimental Procedure 2 "AC4"

- Resin mixture application of 12 g/m$^2$ containing 12 wt % of glass with specification of 70 to 110 μm, resulting in abrasion of 4200 revolutions
- Resin mixture application of 16 g/m$^2$ containing 14 wt % of glass with specification of 70 to 110 μm, resulting in abrasion of 4400 revolutions
- Resin mixture application of 20 g/m$^2$ containing 16 wt % of glass with specification of 70 to 110 μm, resulting in abrasion of 4600 revolutions The conditions prevailing during the application of the outer layer 8 were as follows:

- Line speed 60 to 100 m/min.
- In order to keep the operation constant, the manufacturing hall was air-conditioned and the paint line was temperature-conditioned. Furthermore, metering and monitoring took place automatically.

As the experiments described above have shown, there was a greater abrasion resistance relative to conventionally coated boards, with an improvement in the micro-scratch resistance, and the chemical incorporation of the glass into the melamine resin resulted in a uniform areal distribution, which also resulted in an improved surface density against impact load. All in all, therefore, the implementation of the method of the invention leads to a simple and reliable regime of the manufacturing operation and also, in the end product, to an improvement in the robustness of the surface, and hence to improved service properties on the part of the construction board.

Within the coating operation, not only is the decoration 7 sealed, but it is also possible to stack up to 1000 panels one on top of another without them sticking to one another. It has emerged that stacks of this kind can be stored for up to 180 days and that destacking is possible even at 35° C. The degree of condensation is not measurable. The stack is stored preferably at 25° C. and at atmospheric humidity of 40% to 60%. The improved transparency relative to that with cellulose, a more sharply defined decorative print, and improved colors in the decoration are fully manifested as a result of the melamine/glass bead mixture, not least because the resulting surface is uniformly impervious.

The invention claimed is:

1. A method for treating a woodbase material board in order to achieve a tack-free surface following printing of a decoration onto at least one top face of the woodbase material board, comprising applying to the decoration a cellulose-free outer layer of melamine resin into which glass beads have been mixed, drying the outer layer resulting in the tack-free surface at an intermediate stage of production, and applying an antiwear layer to the outer layer, wherein the drying is performed prior to the applying of the antiwear layer.

2. The method as claimed in claim 1, further comprising actively drying the outer layer.

3. The method as claimed in claim 1, wherein the glass beads are used in silanized form.

4. The method as claimed in claim 1, further comprising applying the melamine resin/glass bead mixture in an amount of 10 to 30 g/m$^2$.

5. The method as claimed in claim 1, further comprising applying the melamine resin/glass bead mixture in an amount of 12 to 20 g/m$^2$.

6. The method as claimed in claim 1, wherein a fraction of glass beads in the mixture is 12 to 16 wt %.

7. The method as claimed in claim 6, wherein a diameter of the glass beads is in a range from 60 to 90 μm.

8. The method as claimed in claim 6, wherein a diameter of the glass beads is in a range from 70 to 110 μm.

9. The method as claimed in claim 1, further comprising applying a primer layer composed of 15 to 40 g/m$^2$ of an aqueous melamine resin to the top face of the woodbase material board.

10. The method as claimed in claim 9, wherein the woodbase material board is a woodbase material/plastic mixture.

11. The method as claimed in claim 9, further comprising applying a base of an aqueous paint to the primer layer.

12. The method as claimed in claim 11, wherein the base is a white base having a application of 20 to 30 g/m$^2$ of the aqueous white paint.

13. The method as claimed in claim 11, wherein the decoration consists of a plurality of successively applied decorative prints.

14. The method as claimed in claim 13, wherein the decorative prints is applied by offset printing or a digital printing.

15. The method as claimed in claim 13, wherein the outer layer consists of an aqueous melamine resin/glass bead mixture with an application quantity of 10 to 30 g/m$^2$.

16. The method as claimed in claim 15, wherein the glass beads are mixed into the resin have a diameter of 60 to 110 μm.

17. A method for treating a woodbase material board in order to achieve a tack-free surface following printing of a decoration onto at least one top face of the woodbase material board, comprising applying to the decoration a cellulose-free outer layer of melamine resin into which glass beads have been mixed, drying the outer layer, applying an antiwear layer to the outer layer, applying a primer layer composed of 15 to 40 g/m$^2$ of an aqueous melamine resin to the top face of the woodbase material board and applying a base of an aqueous paint to the primer layer, wherein:

the drying is performed prior to the applying of the antiwear layer, the decoration consists of a plurality of successively applied decorative prints, the outer layer consists of an aqueous melamine resin/glass bead mixture with an application quantity of 10 to 30 g/m$^2$, the glass beads are mixed into the resin have a diameter of 60 to 110 μm, and the drying of the outer layer is actively drying the outer layer, and the antiwear layer is composed of a melamine resin/corundum/cellulose fiber mixture applied in an amount of 30 to 50 g/m$^2$.

18. The method as claimed in claim 17, further comprising pressing the woodbase material board in a short-cycle press to form woodbase material panels.

19. The method of claim 18, further comprising stacking up to 1000 woodbase material panels one on top of another without them sticking to one another.

20. The method of claim 19, wherein the stack is stored preferably at 25° C. and at atmospheric humidity of 40% to 60%.

21. The method of claim 19, further comprising destacking of the stack at 35° C.

* * * * *